US007620999B2

(12) United States Patent
Winningham

(10) Patent No.: US 7,620,999 B2
(45) Date of Patent: Nov. 24, 2009

(54) TRIGGER FINGER PROTECTIVE GLOVE

(75) Inventor: Matthew Winningham, Royal Oak, MI (US)

(73) Assignee: Warrior Sports, Inc., Warren, MI (US)

( * ) Notice: Subject to any disclaimer, the term of this patent is extended or adjusted under 35 U.S.C. 154(b) by 0 days.

(21) Appl. No.: 11/533,147

(22) Filed: Sep. 19, 2006

(65) Prior Publication Data

US 2007/0028355 A1 Feb. 8, 2007

Related U.S. Application Data

(63) Continuation of application No. 10/908,650, filed on May 20, 2005, now Pat. No. 7,114,193.

(60) Provisional application No. 60/572,678, filed on May 20, 2004.

(51) Int. Cl.
*A41D 19/00* (2006.01)

(52) U.S. Cl. ..... 2/163; 2/161.1; 2/159

(58) Field of Classification Search ..... 2/16, 2/20, 159, 160, 161.1, 161.6, 163
See application file for complete search history.

(56) References Cited

U.S. PATENT DOCUMENTS

| | | | | |
|---|---|---|---|---|
| 2,293,347 A | | 8/1942 | Lindfelt | |
| 2,708,753 A | | 5/1955 | Kennedy | |
| 2,831,196 A | | 4/1958 | Scheiber | |
| 3,387,306 A | | 6/1968 | Korey | |
| 4,484,359 A | | 11/1984 | Tirinen | |
| 4,497,073 A | | 2/1985 | Deutsch | |
| 4,519,097 A | * | 5/1985 | Chappell et al. | 2/16 |
| 4,677,698 A | | 7/1987 | Angas | |
| 4,815,147 A | | 3/1989 | Gazzano et al. | |
| 4,894,866 A | * | 1/1990 | Walker | 2/161.6 |
| 4,894,868 A | | 1/1990 | Christopher | |
| 4,930,162 A | | 6/1990 | Cote | |
| 5,237,703 A | | 8/1993 | Brine et al. | |
| 5,329,639 A | | 7/1994 | Aoki | |
| 5,390,372 A | | 2/1995 | Hashimoto et al. | |
| 5,459,883 A | | 10/1995 | Garceau-Verbeck | |

(Continued)

FOREIGN PATENT DOCUMENTS

DE 2842720 4/1980

(Continued)

OTHER PUBLICATIONS

Debeer, "Response" Glove (2004).

(Continued)

*Primary Examiner*—Katherine Moran
*Assistant Examiner*—Richale L Quinn
(74) *Attorney, Agent, or Firm*—Werner Norcross & Judd LLP

(57) ABSTRACT

A protective glove for protecting a wearer's hand includes a thumb pocket and an index finger pocket. The glove is designed to receive the wearer's thumb in the thumb pocket and the wearer's index finger in the index finger pocket while leaving the user's other fingers exposed. The thumb pocket and the index finger pocket are attached to an adjustable wrist strap. Further, the thumb pocket and the index finger pocket are attached to each other.

30 Claims, 3 Drawing Sheets

U.S. PATENT DOCUMENTS

| | | | | |
|---|---|---|---|---|
| 5,488,739 | A | 2/1996 | Cardinal | |
| 5,511,243 | A | 4/1996 | Hall et al. | |
| 5,781,929 | A | 7/1998 | Shikatani | |
| 5,787,506 | A | 8/1998 | Wilder et al. | |
| 5,946,720 | A | 9/1999 | Sauriol | |
| 5,983,396 | A | 11/1999 | Morrow et al. | |
| 6,085,354 | A | 7/2000 | Wilder et al. | |
| 6,122,769 | A | 9/2000 | Wilder et al. | |
| 6,209,137 | B1 | 4/2001 | Wallick | |
| 6,405,380 | B1 * | 6/2002 | Kuroda et al. | 2/161.1 |
| 6,550,069 | B1 | 4/2003 | Morrow | |
| 6,625,815 | B2 | 9/2003 | Litke | |
| 6,681,402 | B1 | 1/2004 | Bevier et al. | |
| 2004/0010834 | A1 | 1/2004 | Sidlo | |
| 2004/0060096 | A1 | 4/2004 | Thiruppathi | |

FOREIGN PATENT DOCUMENTS

| | | |
|---|---|---|
| DE | 2843448 | 4/1980 |
| DE | 3135756 | 4/1983 |

OTHER PUBLICATIONS

Debeer, "Tropic" Glove (2004).
Debeer, "Arctic" Glove (2004).
Brine, "Half-Finger" Glove (2004).
Brine, "Winter" Glove (2004).
Brine, "Performance" Glove (2004).
Brine, "Elite" Glove (2004).
Brine, "Element" Glove (2004).
STX, "Reflex" Glove (2004).
STX, "Winter" Glove (2004).
STX, "¾ Finger" Glove (2004).
1994-1995 STX Lacrosse Equipment Catalog, p. 8.
1987 Brine Lacrosse Catalog, pp. 12-13.
1983 Bacharach Rasin Lacrosse Catalog, p. 2.
1981 STX Catalog, page unknown.
1980 STX Lacrosse Catalog, page unknown.
1975 STX Lacrosse Catalog, p. 11.

* cited by examiner

TRIGGER FINGER PROTECTIVE GLOVE

CROSS-REFERENCE TO RELATED APPLICATION

This application is a continuation of application Ser. No. 10/908,650, filed May 20, 2005 and entitled "Trigger Finger Protective Glove," which claims the benefit of U.S. Provisional Application No. 60/572,678, filed May 20, 2004 and entitled "Trigger Finger Protective Glove".

TECHNICAL FIELD

The present invention generally relates to protective sports gloves and, particularly to protective sports gloves for use by participants in the sport of lacrosse. More specifically, the present invention relates to a protective glove that is lighter, provides more ventilation, and is more mobile than conventional protective gloves.

BACKGROUND OF THE INVENTION

In contact sports, such as lacrosse or hockey, where sticks are essential elements of the game, a player's hands and wrists are especially vulnerable to injury when being checked by another player's stick. For this reason, players typically utilize padded gloves to protect their hands, wrists and lower forearms during play. While the gloves are intended to provide protection, players also desire gloves that maximize flexibility such that the player can flex his hand in a relatively unrestricted fashion and also manipulate the stick as required.

In the sport of lacrosse, checking includes wacking or hitting a player's stick with another player's stick in an effort to disrupt their ability to control the ball or puck. Checking in this fashion to dislodge the ball from another player's lacrosse head is an accepted part of the game in men's lacrosse. Accordingly, more padding or protection is desirable and typically utilized in protective gloves intended for men's lacrosse. While checking is not permitted in women's lacrosse, some degree of protection is still desired. This is because lacrosse is a contact sport and a player's stick can still contact another's hand in women's lacrosse, just not to the same degree of frequency as occurs in men's lacrosse. Thus, the amount of padding necessary or desired for women's lacrosse is not the same as required for men's lacrosse.

Lacrosse is a sport that is primarily played in the spring and summer months. Due to the increase in temperature and humidity during these months, ventilation of a player's hands is also a desirable feature. Accordingly, protective sports gloves have been made with openings formed in the padded back of the glove to allow ventilation of the wearer's hand by allowing air circulation. See, for example, U.S. Pat. No. 5,787,506. Further, other protective sports gloves have been formed with mesh openings in the leather palm that allow further air circulation to the wearer's hand. See, for example, U.S. Pat. No. 6,550,069. Faced with these competing concerns, lacrosse players seek a glove that provides coverage to protect vulnerable areas on their hands, but still provides improved ventilation and mobility.

SUMMARY OF THE INVENTION

It is, therefore, an advantage of the present invention to provide a protective sports glove that provides increased ventilation.

It is a further advantage of the present invention to provide a protective sports glove that provides increased mobility.

It is another advantage of the present invention to provide a protective sports glove that is intended for use by women in the game of lacrosse.

It is still another advantage of the present invention to provide a protective sports glove that allows a player to have increased feel.

It is yet another advantage of the present invention to provide a protective sports glove that provides protection for a player's hands in the areas where it is most vulnerable.

It is still a further advantage of the present invention to provide a protective sports glove that is configured as "Trigger Finger" where a wearer's thumb and index finger are covered with the other fingers being exposed.

In accordance with the above and the other advantages of the present invention, a protective sports glove is provided. The glove covers at least two, but less than all, of the wearer's fingers. This configuration, which leaves some fingers uncovered, allows the wearer to have a better grip on the lacrosse stick. Further, coverage is provided in the areas most vulnerable on the hands of a player. It is known that in women's lacrosse most cuts and bruises occur on the top of the wearer's hand and, in particular, between the thumb and the index finger. This can occur, for example, when a player gets checked on the top of the hand by another player. This can also occur, when a player takes a shot and upon following through hits the index finger and/or thumb on another player's stick.

More specifically, the protective sports glove covers only a wearer's index finger, a thumb, a portion of the wearer's palm, and a portion of the back of the wearer's hand opposite the palm. The disclosed glove includes a wrist strap that secures the glove to the wearer's hand, including, an index finger pocket and a thumb pocket. The wearer's other fingers remain uncovered. The glove also includes numerous openings for improved ventilation. There is at least one opening on the palm side of the glove and at least one opening on the back side of the glove.

These and other features of the present invention will become apparent from the following description of the invention, when viewed in accordance with the accompanying drawings and appended claims.

BRIEF DESCRIPTION OF THE DRAWINGS

The present invention will be described by way of example with reference to the following drawings.

DETAILED DESCRIPTION OF THE PREFERRED EMBODIMENT

Figure 1:
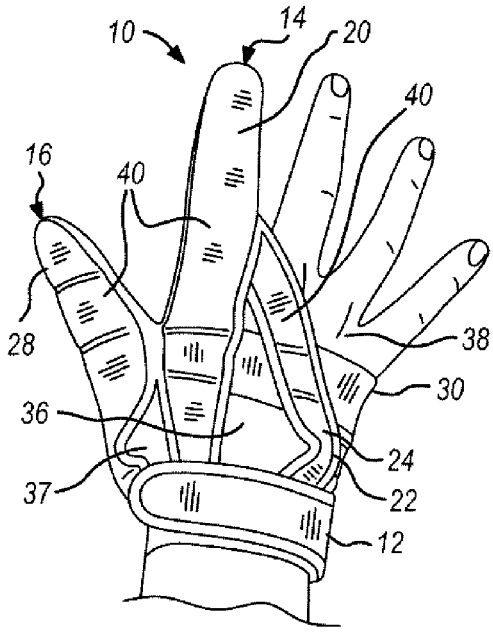
FIG. 1 illustrates a back side view of a protective sports glove in accordance with one embodiment of the present invention.
Figure 2:
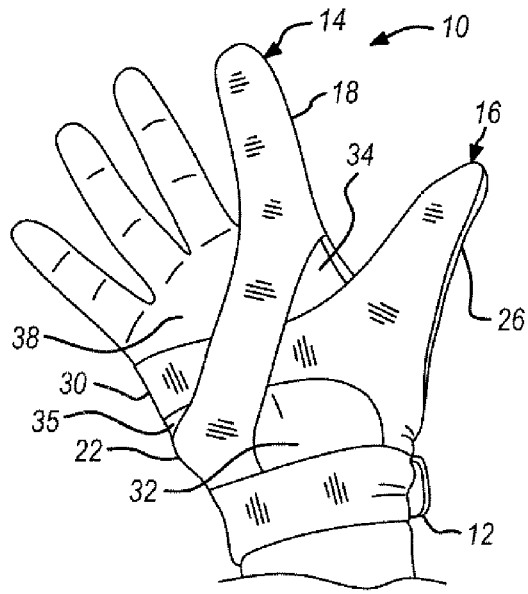
FIG. 2 illustrates a palm side view of the glove illustrated in FIG. 1.

Referring to FIGS. 1 and 2, which illustrate a protective glove 10 in accordance with one embodiment of the present invention. The protective glove is preferably for use in women's lacrosse, but may be utilized in a variety of other sports or applications. As shown, the protective glove 10, includes a wrist strap 12, an index finger pocket 14, which is intended to receive a wearer's finger, and a thumb pocket 16, which is intended to receive a wearer's thumb. The index finger pocket 14 and the thumb pocket 16 are preferably constructed of a cloth material. However, they may be constructed of a variety of other suitable materials.

The index finger pocket 14 and the thumb pocket 16 are both preferably attached to the wrist strap 12 at their respective lower ends. Further, the index finger pocket 14 and the thumb pocket 16 are also preferably attached to each other. Thus, in accordance with one embodiment, when a wearer is wearing the glove 10, the wearer's index finger and thumb are covered by the glove 10, while the wearer's remaining fingers are exposed or uncovered to provide increased grip by those fingers as well as increased breathability and ventilation to the hand. It will be understood that while the glove 10 in this embodiment, only covers two fingers, more or less fingers may be covered. For example, the pinkie could also be covered. Alternatively some or all of the fingers may be partially covered, such as by a half pocket. Thus, the fingers may consist of a combination of pockets and half pockets.

The index finger pocket 14 receives a wearer's index finger when in use. In general, the index finger pocket 14 includes a palm portion 18 and a back side portion 20. The palm portion 18 of the index finger pocket 14 is adjacent to the palm side of the wearer's index finger when in use. The back side portion 20 of the index finger pocket 14 is adjacent to the opposite side of the wearer's hand or, in other words, the back of the wearer's finger. The back of the wearer's hand can also be referred to as the front of the wearer's hand. The index finger pocket 14 also includes a first index finger strap 22 and a second index finger strap 24.

The second index finger strap 24 extends generally from a connection with the index finger back portion 20 to a connection with the wrist strap 12. The second index finger strap 24 lies adjacent to the back of the wearer's hand when in use. The first index finger strap 22 is also referred to as a first side strap. The first index finger strap 22 extends generally from a connection with the index finger palm portion 18 around the side of the wearer's hand to an attachment with the second index finger strap 24. The first index finger strap 22 is preferably formed of an elastic material. The first index finger strap 22 and the second index finger strap 24 assist in retaining the glove 10 securely on the wearer's hand.

The thumb pocket 16 receives a wearer's thumb when being worn and includes a thumb palm portion 26, a thumb back portion 28, and a thumb strap 30. Similar to the index finger pocket 14, the thumb palm portion 26 is located adjacent to the wearer's palm when in use while the thumb back portion 28 is located adjacent to the back of the wearer's thumb.

The thumb strap 30, which is also referred to as the second side strap, extends generally from a connection with the thumb pocket palm portion 26 around the wearer's hand and to an attachment with the thumb pocket back portion 28. In one embodiment, the thumb strap 30 begins at the location where it contacts the index finger palm portion 18. The thumb strap 30 is also preferably attached to both the second index finger strap 24 and the index finger back portion 20. Obviously, the thumb strap 30 can take on a variety of different configurations and orientations.

In one embodiment, the second side strap 30 is made from an elastic material and helps the glove fit snugly on the wearer's hand. It will be understood that the side straps 22, 30 may be constructed of other materials as desired. The first side strap 22 may be narrower than the second side strap 30. The various sections of the glove 10 can be attached to each other by a number of different methods, including, but not limited to, sewing them together and gluing them together. Further, the glove 10 may have more or less straps as desired. Additionally, the straps may take on a variety of different sizes, shapes, and configurations.

The wrist strap 12 preferably extends completely around the wearer's wrist when in use and is adjustable to secure the protective glove 10 and maintain it on the wearer's hand. The wrist strap 12 is preferably constructed of an elastic material. The wrist strap 12 includes a pair of releasable ends that allow for adjustment of the strap allowing the wearer to tighten the strap 12 to a desired tension around the wearer's wrist as desired. In one embodiment, the wrist strap 12 is adjustable via the use of VELCRO®, which is also known as hook and loop attachment. While this is the preferred attachment mechanism, other suitable attachment mechanisms may be utilized.

The protective glove 10 includes numerous openings for improved ventilation in both the palm and the back. Specifically, there is at least one opening on the palm side of the glove 10 and at least one opening on the back side of the glove 10. In other words, when the glove 10 is being worn, there are exposed areas of the wearer's hand due to the open design of the protective glove 10 for the purposes of ventilation. On the palm side of the glove 10, there is a first open area 32 defined or bordered by the thumb pocket palm portion 26, the thumb pocket strap 30, the index finger palm portion 18, and the wrist strap 12. There is a second open area 34, also on the palm side of the glove 10, which is defined or bounded by the thumb pocket palm portion 26, the thumb pocket strap 30, the index finger palm portion 18, and the index finger back portion 20. There is a third open area 35 depending upon the size of the straps and how they are configured. The third open area 35 is located near the pinkie side of the hand and is defined or bounded by the thumb pocket strap 30 and the first side strap 22.

On the back side of the glove 10, there is a fourth open area 36 defined or bounded by the index finger pocket back portion 20, the thumb strap 30, the index finger second strap 24, and the wrist strap 12. There is a fifth open area 37 defined or bounded by the thumb pocket back portion 28, the index finger back portion 20, and the wrist strap 12.

There is another open area 38, extending across both the back and palm portions of the glove 10, which is defined by the index finger pocket palm portion 18, the thumb pocket strap 30, and the index finger second strap 24. This open area 38 exposes a portion of the wearer's palm, a portion of the back of the hand, and the remainder of the wearer's fingers. In other words, the three fingers included in the open area 38 are not covered by any portion of the glove 10. The material of the glove in the palm is preferably oriented such that it covers or protects the high use areas or areas where a player movably holds or grips a lacrosse stick. In other words, the openings are, therefore, preferably formed in the non-high use areas.

The index finger back portion 20, the index finger second strap 24, and the thumb back portion 28 all preferably have padding 40 to protect vulnerable areas of the wearer's hand. Alternatively, instead of a padded material 40, these portions may be constructed of other materials that provide protection to these portions of a wearer's hand. It will be understood that other portions of the glove 10 may have padded or protective material formed thereon. Further, there may be sections with mesh in the non-high use areas in the palm of the glove to provide a wearer with additional ventilation.

Figure 3:
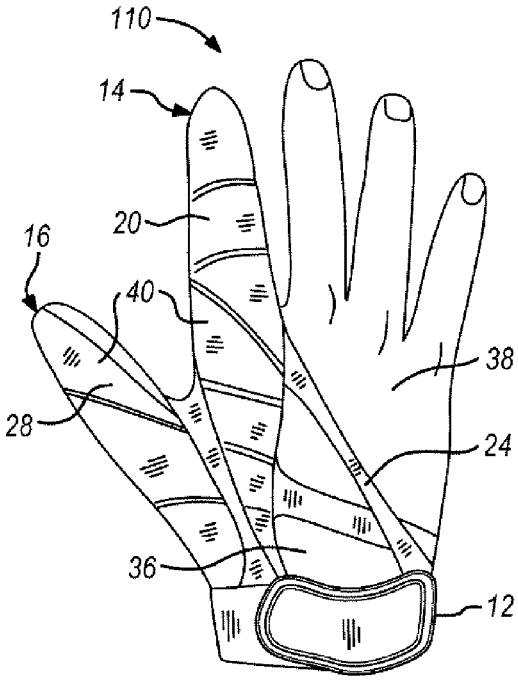
FIG. 3 illustrates a back side view of a protective sports glove in accordance with another embodiment of the present invention.
Figure 4:
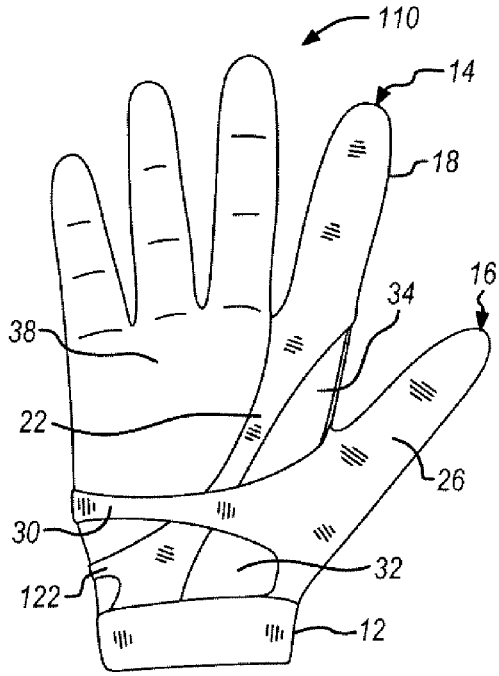
FIG. 4 illustrates a palm side view of the glove illustrated in FIG. 3.

FIGS. 3 and 4 illustrate an alternative embodiment of the protective glove, which is generally identified by reference number 110. One difference between the two embodiments is the attachment of the index finger strap 22. In the first embodiment, the index finger strap or first side strap 22 could be a separate piece of material that is attached to and extends between both the index finger palm portion 18 and the second index finger strap 24. In the alternative embodiment, the index finger strap 122 is a section extending from the same piece of material that defines the index finger palm portion 18.

Figure 5:
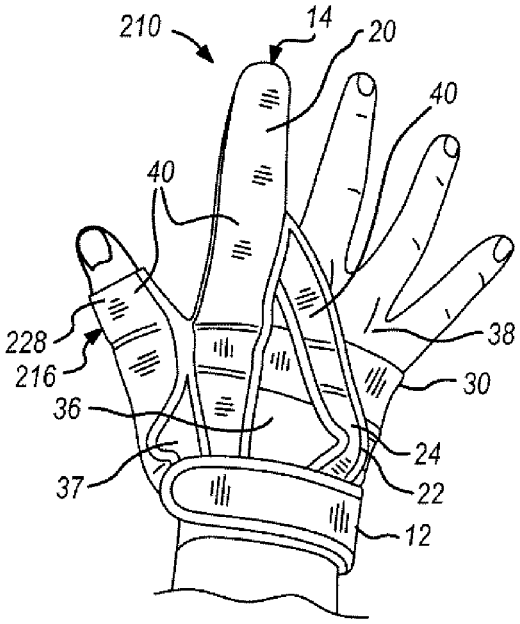
FIG. 5 illustrates a back side view of a protective glove in accordance with yet another embodiment of the present invention having a thumb half pocket.
Figure 6:
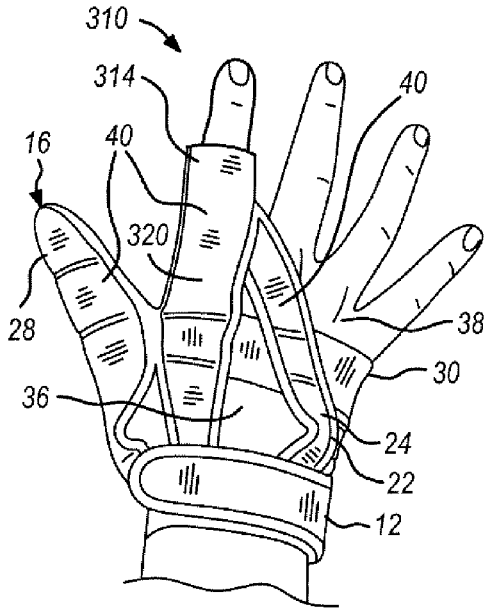
FIG. 6 illustrates a back side view of a protective glove in accordance with yet another embodiment of the present invention having an index finger half pocket.
Figure 7:
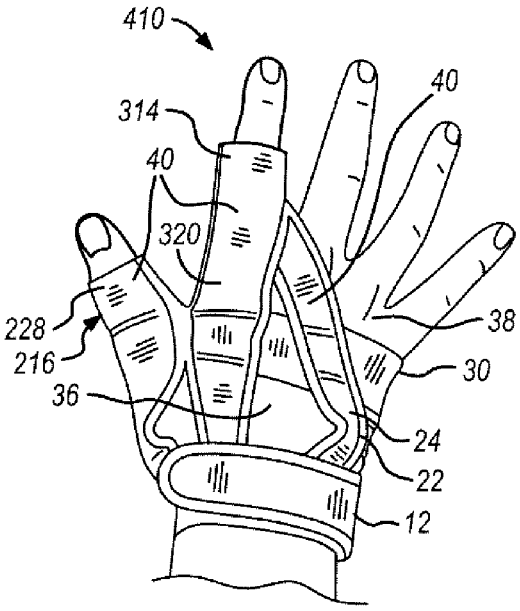
FIG. 7 illustrates a back side view of a protective glove in accordance with yet another embodiment of the present invention having both a thumb half pocket and an index finger half pocket.

FIGS. 5-7 illustrate other embodiments of the protective glove. These figures illustrate a protective glove including a wrist strap, a thumb pocket attached to the wrist strap, an index finger pocket attached to the wrist strap, a second index finger strap attached to the index finger pocket and the wrist strap and where the players' remaining fingers remain uncovered. However, at least one of either the thumb pocket or the index finger pocket is a half pocket or they are both half pockets.

FIG. 5 illustrates another alternative embodiment of the protective glove, which is generally identified by reference number 210. This embodiment of the protective glove 210 incorporates a half-pocket for the thumb pocket 216. The half thumb pocket 216 covers a portion of the player's thumb and exposes another portion of the player's thumb during use or when it is being worn. The half thumb pocket 216 includes a padded back portion 228 and an unpadded palm portion 226. FIG. 5 illustrates the half thumb pocket 216 covering the lower portion of the player's thumb and exposing the tip of the player's thumb. However, it should be understood that the half pocket could be designed to cover the tip of the player's thumb and expose the lower portion of the thumb.

FIG. 6 illustrates another alternative embodiment of the protective glove, which is generally identified by reference number 310. This embodiment of the protective glove 310 incorporates a half-pocket for the index finger pocket 314. The half index finger pocket 314 covers a portion of the player's index finger and exposes another portion of the player's index finger during use or when it is being worn. The half index finger pocket 314 includes a padded back portion 320 and an unpadded palm portion 318. FIG. 6 illustrates the half index finger pocket 314 covering the lower portion of the player's index finger and exposing the tip of the player's index finger. However, it should be understood that the half pocket 314 could be designed to cover the tip of the player's index finger and expose the lower portion of the index finger.

FIG. 7 illustrates another alternative embodiment of the protective glove, which is generally identified by reference number 410. This embodiment of the protective glove 410 incorporates a half pocket for the thumb 216 and a half pocket for the index finger 314.

Figure 8:
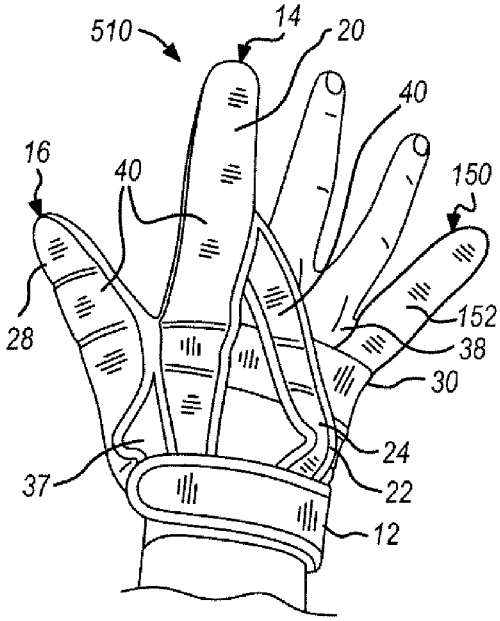
FIG. 8 illustrates a back side view of a protective glove in accordance with yet another embodiment of the present invention having a second finger pocket that covers the pinkie finger.
Figure 9:
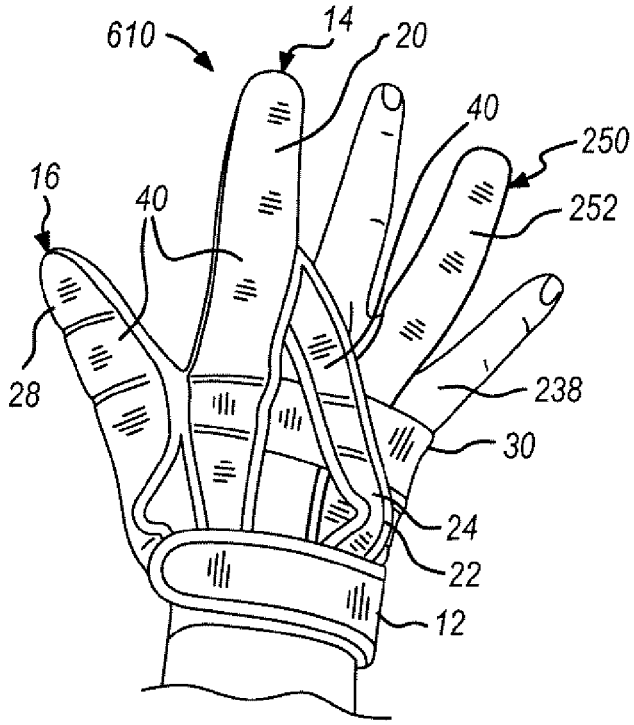
FIG. 9 illustrates a back side view of a protective glove in accordance with yet another embodiment of the present invention having a second finger pocket that covers the ring finger.
Figure 10:
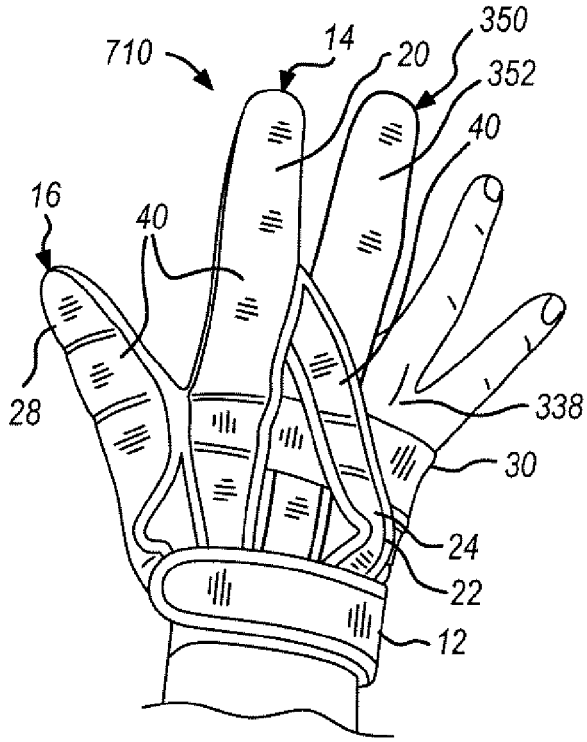
FIG. 10 illustrates a back side view of a protective glove in accordance with yet another embodiment of the present invention having a second finger pocket that covers the middle finger.

FIGS. 8-10 illustrate several more embodiments of the protective glove including three protective pockets. These figures illustrate a protective glove including a wrist strap, a thumb pocket attached to the wrist strap, an index finger pocket attached to the wrist strap, a second index finger strap attached to the index finger pocket and the wrist strap, and a second finger pocket attached to the wrist strap and wherein the player's other two fingers remain uncovered during use.

FIG. 8 illustrates an alternative embodiment of the protective glove, which is generally identified by reference number 510. Protective glove 510 covers the player's pinkie finger by second finger pocket 150 when being worn by a player. Second finger pocket 150 includes a padded back portion 152 and an unpadded palm portion 154. Open area 138 is defined by index finger pocket palm portion is, thumb pocket strap 30, second finger pocket 150 and index finger second strap 24.

FIG. 9 illustrates an alternative embodiment of the protective glove, which is generally identified by reference number 610. Protective glove 610 covers the player's ring finger by second finger pocket 250 when being worn by a player. Second finger pocket 250 includes a padded back portion 252 and an unpadded palm portion 254. Open area 238 is defined by second finger pocket 250 and thumb pocket strap 30.

FIG. 10 illustrates an alternative embodiment of the protective glove, which is generally identified by reference number 710. Protective glove 710 covers the players' middle finger by second finger pocket 350 when being worn by a player. Second finger pocket 350 includes a padded back portion 352 and an unpadded palm portion 354. Open area 338 is defined by second finger pocket 350 and thumb pocket strap 30.

It is to be understood that while a glove that can be worn on a wearer's right hand is shown in FIGS. 1-10, the present invention also includes a glove that can be worn on a wearer's left hand. The glove for use on a wearer's left hand would be a mirror image of the glove shown in FIGS. 1-10.

While the present invention has been described in what is presently considered to be its most practical and preferred embodiment or implementation, it is also to be understood that the invention is not to be limited to the disclosed embodiment. On the contrary, the present invention is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A protective glove for use during sporting activities to protect a player's hand, said athletic protective glove comprising:

an adjustable wrist strap for securing the glove on the player's hand;

a thumb pocket attached to said wrist strap, wherein said thumb pocket includes a padded back portion and an unpadded palm portion, said thumb pocket is intended to receive a player's thumb;

an index finger pocket attached to said wrist strap, wherein said index finger pocket includes a back portion that is padded substantially over its entire area and an unpadded palm portion, said index finger pocket is intended to receive a player's index finger;

a first index finger strap attached to said padded back portion of said index finger pocket and said wrist strap, wherein said index finger strap is padded substantially along its entire length; and wherein at least two of the player's other three fingers remain uncovered.

2. The protective glove of claim 1, further comprising:

a second index finger strap attached to said unpadded palm portion of said index finger pocket and said wrist strap.

3. The protective glove of claim 2, further comprising: a thumb side strap extending between said thumb pocket padded back portion and said thumb pocket unpadded palm portion.

4. The protective glove of claim 3, further comprising:

a first open area defined by said thumb pocket palm portion, said thumb pocket strap, said second index finger palm portion, and said wrist strap.

5. The protective glove of claim 4 further comprising:

a second open area defined by said index finger pocket back portion, said thumb strap, said first index finger strap and said wrist strap.

6. The protective glove of claim 2, wherein said first index finger strap and said second index finger strap are made from an elastic material.

7. The protective glove of claim 1, wherein said thumb pocket consists of a half pocket.

8. The protective glove of claim 1, wherein said index finger pocket consists of a half pocket.

9. A protective sports glove for a wearer's hand, comprising:

a wrist strap;

a thumb pocket having a padded back portion and an unpadded palm portion, said thumb pocket being attached to said wrist strap, said thumb pocket intended for receipt of a wearer's thumb;

an index finger pocket having a back portion that is padded substantially over its entirety and an unpadded palm portion, said index finger pocket being attached to said wrist strap, said index finger pocket intended for receipt for a wearer's index finger;

a first index finger strap attached to said index finger pocket and said wrist strap; and at least one open area defined on the glove between said thumb pocket and said index finger pocket said at least one open area being defined entirely on a back portion of the glove wherein the junction between said back portion and a palm portion remains covered;

wherein at least two of the wearer's fingers remain uncovered.

10. The protective glove of claim 9, wherein said wrist strap includes an adjustable mechanism to allow the glove fit to be tightened or loosened by a wearer as desired.

11. The protective glove of claim 10, wherein said adjustable mechanism is a hook and loop attachment.

12. The protective glove of claim 9, wherein said at least one open area is located in the glove to expose a portion of a back of a wearer's hand.

13. The protective glove of claim 9, wherein said at least one open area is located in the glove to expose a portion of a front of a wearer's hand.

14. The protective glove of claim 9, wherein said first index finger strap is attached to said padded back portion of said index finger pocket and said wrist strap, wherein said index finger strap is padded.

15. The protective glove of claim 14, further comprising:

a second index finger strap attached to said unpadded palm portion of said index finger pocket and said wrist strap.

16. The protective glove of claim 15, further comprising:

a thumb side strap attached to said unpadded thumb pocket palm portion and said padded thumb pocket back portion.

17. The protective glove of claim 16, wherein said at least one open area is defined by said thumb pocket, said first index finger strap, said wrist guard, and said thumb side strap.

18. The protective glove of claim 16, wherein said at least one open area is defined by said thumb pocket, said second index finger strap, said wrist guard, and said thumb side strap.

19. The protective glove of claim 9, wherein said thumb pocket consists of a half pocket covering a portion of the wearer's thumb and exposing another portion of the wearers thumb.

20. The protective glove of claim 9, wherein said index finger pocket consists of a half pocket covering a portion of the wearer's index finger and exposing another portion of the wearer's index finger.

21. A protective glove for use during sporting activities to protect a player's hand, said athletic glove comprising:

a wrist strap;

a thumb pocket attached to said wrist strap, wherein said thumb pocket includes a padded back portion and an unpadded palm portion, said thumb pocket intended to receive a player's thumb;

an index finger pocket attached to said wrist strap, wherein said index finger pocket includes a padded back portion and an unpadded palm portion, said index finger pocket intended to receive a player's index finger;

a first index finger strap attached to said index finger pocket and said wrist strap, wherein said index finger strap is padded;

a first open area defined between said padded portion of said thumb pocket, said first index finger strap, and said wrist guard; and wherein at least two of other player's three fingers remain uncovered.

22. The protective glove of claim 21, wherein said thumb pocket is a half pocket covering a portion of the player's thumb and exposing another portion of the player's thumb during use.

23. The protective glove of claim 21, wherein said index finger pocket is a half pocket covering a portion of the player's index finger and exposing another portion of the player's index finger during use.

24. The protective glove of claim 21, further comprising: a second index finger strap attached to said index finger pocket and said wrist strap, wherein said index finger strap is unpadded.

25. The protective glove of claim 24, further comprising: a thumb side strap extending between said unpadded thumb pocket palm portion and said padded thumb pocket back portion.

26. The protective glove of claim 25 further comprising:

a second open area defined between said thumb side strap, said second index finger strap, said thumb pocket, and said wrist guard.

27. A protective glove for use during sporting activities to protect a player's hand, said athletic protective glove comprising:

a wrist strap;

a thumb pocket attached to said wrist strap, wherein said thumb pocket includes a padded back portion and an unpadded palm portion;

an index finger pocket attached to said wrist strap, wherein said index finger pocket includes a padded back portion and an unpadded palm portion;

a first index finger strap attached to said index finger pocket and said wrist strap, wherein said first index finger strap is padded;

a second finger pocket attached to said wrist strap, wherein said second finger pocket includes a padded back portion and an unpadded palm portion;

a second index finger strap attached to said index finger pocket and said wrist strap; and a first open area defined between said thumb padded portion of said thumb pocket, said first index finger strap, and said wrist guard;

wherein the player's other two fingers remain uncovered.

28. The protective glove of claim 27, wherein said second finger pocket covers the player's pinkie finger during use.

29. The protective glove of claim 27, wherein said second finger pocket covers the player's ring finger during use.

30. The protective glove of claim 27, wherein said second finger pocket covers the player's middle finger during use.

* * * * *

UNITED STATES PATENT AND TRADEMARK OFFICE

CERTIFICATE OF CORRECTION

PATENT NO. : 7,620,999 B2
APPLICATION NO. : 11/533147
DATED : November 24, 2009
INVENTOR(S) : Matthew Winningham It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 63 days.

Signed and Sealed this

Twenty-sixth Day of October, 2010

David J. Kappos

David J. Kappos
*Director of the United States Patent and Trademark Office*